US006039837A

United States Patent [19]

Brännland et al.

[11] Patent Number: 6,039,837

[45] Date of Patent: Mar. 21, 2000

[54] METHOD OF BLEACHING PULP WITH OZONE WHEREIN THE ACIDITY IS MAINTAINED WITH AN ACID SOLUTION PREPARED BY ELECTROLYSIS OR ELECTRODIALYSIS

[75] Inventors: Rolf C. A. Brännland, Bromma; Sture E. O. Noréus, Husum, both of Sweden

[73] Assignee: Mo Och Domsjö Aktiebolag, Örnsköldsvik, Sweden

[21] Appl. No.: 09/112,325

[22] Filed: Jul. 9, 1998

Related U.S. Application Data

[63] Continuation of application No. 08/774,674, Dec. 26, 1996, abandoned, which is a continuation of application No. 08/204,368, Sep. 2, 1994, abandoned.

[30] Foreign Application Priority Data

Sep. 17, 1991 [SE] Sweden ..... 9102693

[51] Int. Cl.[7] ..... D21C 9/153; D21C 11/00

[52] U.S. Cl. ..... 162/29; 162/30.1; 162/33; 162/37; 162/65

[58] Field of Search ..... 162/30.1, 33, 30.11, 162/65, 16, 29, 37, 50, 35, 36

[56] References Cited

U.S. PATENT DOCUMENTS

| | | | |
|---|---|---|---|
| 3,833,462 | 9/1974 | Moy et al. | 162/30.11 |
| 4,080,249 | 3/1978 | Kempf et al. | 162/65 |
| 4,450,044 | 5/1984 | Fritzvold et al. | 162/65 |
| 5,034,094 | 7/1991 | Kurple | 162/30.11 |
| 5,061,343 | 10/1991 | Azarniouch et al. | 162/30.11 |

FOREIGN PATENT DOCUMENTS

| | | |
|---|---|---|
| 2124007 | 11/1984 | European Pat. Off. . |
| 77-063717 | 6/1980 | Sweden . |
| 1292102 | 10/1972 | United Kingdom . |

*Primary Examiner*—Steven Alvo
*Attorney, Agent, or Firm*—Sughrue, Mion, Zinn, Macpeak & Seas, PLLC

[57] ABSTRACT

When closing the process of manufacturing cellulose pulp of high brightness, i.e. including the recovery of essentially all waste liquor, there is an untenable enrichment of certain basic elements, such as sodium and sulphur. The present invention provides a partial solution to this problem and is concerned with a method in bleaching with ozone lignocellulosic material, e.g. cellulose pulp, which has been at least partially manufactured chemically, in the presence of water at a degre of acidity, expressed as pH, of 2–5. The method is characterized in that the acidity is maintained during the ozone bleaching process by adding a sulphuric acid solution or an acid sodium sulphate solution produced by electrolysis or electrodialysis of an essentially neutral sodium sulphate solution obtained by recycling chemicals in a system to which waste liquor from the ozone bleaching process is added.

5 Claims, 3 Drawing Sheets

METHOD OF BLEACHING PULP WITH OZONE WHEREIN THE ACIDITY IS MAINTAINED WITH AN ACID SOLUTION PREPARED BY ELECTROLYSIS OR ELECTRODIALYSIS

This is a continuation of a CPA filed Jan. 23, 1998 of application Ser. No. 08/774,674 filed Dec. 26, 1996, now abandoned; which is a continuation of application Ser. No. 08/204,368 filed Sep. 2, 1994, now abandoned, which was filed under 35 U.S.C. §371 based on PCT/SE92/00635, and claimed priority based on Swedish Patent Application No. 9102693-0, filed Sep. 17, 1991.

TECHNICAL FIELD

The present invention relates to a method in bleaching of lignocellulosic material (cellulose pulp) with ozone.

The cellulose pulp can be produced both chemically and chemimechanically. Chemical cellulose pulps are a clearly defined category of cellulose pulps and are comprised, for instance of sulphite pulp sulphate pulp and polysulphide pulp. Particularly suitable chemical cellulose pulps are those that have a high viscosity at relatively low Kappa numbers. Belonging to this group of cellulose pulps are sulphate pulps which have been cooked or digested at a high sulphidity, and modified sulphate pulps that have been cooked or digested in accordance with a counterflow method in which white liquor is added also during an advanced stage of the cooking process, and alkaline cellulose pulps which are cooked in the presence of one or more catalysts, for instance in the presence of a quinone compound, such as anthraquinone. Other suitable cellulose pulps are those having the designations MSS-AQ (mini—sulphide—sulphite anthraquinone), Si—Sa—Si (sulphite-sulphate-sulphite) and PS-Si (polysulphide-sulphite), all of which are referred to in the journal "Paperi ja Puu", 5/1989, pp. 509–513.

Particularly suitable chemimechanical pulps are those in which the digestion or cooking process is relatively far reaching and is followed by a mechanical defibering process.

The ozone bleaching process can be applied to unbleached cellulose pulp or cellulose pulp which has been delignified/bleached in one or more stages.

PRESENT STANDPOINT OF TECHNIQUES

In recent times, the- use of chlorine as a bleaching agent in the delignification of cellulose pulp has decreased drastically for environmental reasons. Instead, chlorine-free bleaching chemicals, such as oxygen and hydrogen peroxide, have been used to bleach cellulose pulp. Ozone bleaching has also become relevant for application on a full scale, i.e. for use in practice. The use of ozone has previously been inhibited among other things because ozone as a bleaching agent has not been sufficiently selective, i.e. the carbohydrates of the cellulose pulp have been seriously damaged from the attack of free radicals, particularly, at the large ozone additions (10–15 kg ozone per tonne of pulp), that are often required by such processes. It has been realized that an advantage is afforded in the manufacture of, e.g., chemical cellulose pulp when the pulp is subjected to an extensive, or far reaching, digestion process. i.e. are digested to an extent such that the lignin contents, expressed in Kappa numbers, will be much lower than has earlier been usual and/or to greatly reduce the lignin content of the cellulose pulp in a delignifying stage, for instance an oxygen bleaching stage following the cooking process. Since the cellulose pulp to be ozone bleached has a relatively low lignin content, it is possible to use a comparatively small ozone charge. Furthermore, it has been found possible to control the formation of free radicals by the ozone, by maintaining the ozone treatment process at a low pH. low temperature and a relatively high pulp consistency (for instance, a consistency within the range of 10–35%) and by adding radical capturers.

The desire to maintain a low pH in the ozone bleaching process, i.e. a high degree of acidity, particularly following an alkaline cooking process, will put high demands on the washing equipment for removing of cooking liquor from the cellulose pulp and optionally for removing of oxygen bleaching spent liquor from the cellulose pulp. Despite thorough washing of the cellulose pulp there is a certain amount of chemically bound alkali in the cellulose pulp and that alkali consumes hydrogen tons when acidifying the cellulose pulp prior to the ozone treatment process. In addition comes the need of acid (hydrogen ions) in order to obtain the hydrogen ion concentration desired when bleaching the cellulose pulp with ozone. Normally, only sulphuric acid is considered for acidification of the cellulose pulp. The use of, for instance, hydrochloric acid may result in enrichment of chloride in the chemical recovery system, thereby creating corrosion problems.

DISCLOSURE OF THE INVENTION

Technical Problem

The waste liquors deriving from the final pulp bleaching stage have hitherto not generally been returned to the chemical recovery system, but they have been discharged to the recipient. The ever increasing demands placed on emissions to the environment have meant that the release of these liquors to the recipient must be reduced to a minimum. This also applies to relatively harmless compounds in the form, for instance, of non chlorinated but oxygen consuming substances.

When substantially all waste liquors from the bleaching process are returned to the chemical recovery system, a number of basic substances, such as sodium and sulphur, become enriched. Some of these substances must then be ejected from the system, either to air or water, in some form. In the worst of cases, this will result in harm to the environment, for instance when sulphur is ejected in the form of sulphur dioxide and/or hydrogen sulphide. In other case, for instance, sodium sulphate is obtained for which a market cannot be readily found.

Solution

The present invention solves this problem partially and relates to a method in bleaching with ozone lignocellulosic material (cellulose pulp) which has been produced at least partially by chemical processes. In the presence of water and at an acidity expressed as pH, of 2–5. The method is characterized in that the acidity is sustained during the ozone bleaching process by adding to the system either a sulphuric acid solution or an acid sodium sulphate solution prepared by electrolysis (or electrodialysis) of a substantially neutral sodium sulphate solution obtained by recycling chemicals in a system to which rest solution (waste liquor) derived from the ozone bleaching process is passed.

According to the invention, sodium sulphate is taken from the chemical recovery system at some appropriate location. An example of an appropriate location is the electric precipitator in the recovery -boiler included in the chemical recovery system, where the separated -dust contains essentially sodium sulphate and minor quantities of sodium carbonate and sodium chloride.

According to one preferred embodiment of the invention the waste liquor from the ozone bleaching process is mixed with other waste liquor from the pulp manufacturing process, this waste-liquor being recovered and returned to the evaporation and combustion plant (the recovery boiler) of the chemical system. Part of the sodium sulphate collected in the electric precipitator is removed therefrom and dissolved in water and the subsequent solution is then subjected to an electrolysis or an electrodialysis process.

According to another preferred embodiment of the invention, ozone bleaching waste liquor is mixed with waste liquor from an alkaline treatment stage, for instance in the bleaching department, so as to obtain an essentially neutral solution, which is then cooled so that sodium sulphate ($Na_2SO_4$) is precipitated, this sodium sulphate precipitate being separated and led away and dissolved in water and the resulting solution is then subjected to an electrolysis or an electrodialysis process.

The remaining mother liquor, which contains essentially organic materials, is transferred to the chemical recovery system. When the sodium sulphate solution contains metals, such as calcium, magnesium or manganese, in harmful quantities, it is appropriate to treat the solution with a hydrogen saturated cation exchanger prior to the electrolysis or electrodialysis stage.

The sodium sulphate solutions obtained, for instance, in the aforedescribed manner, are subjected to electrolysis or electrodialysis in a cell which is provided with anode, cathode and one or more membranes.

The treatment process can be carried out in at least three ways. According to the simplest alternative, the electrolysis is carried out in a cell that is provided with anode, cathode, and a cation selective membrane, wherein sodium sulphate solution is delivered to the anode chamber and water is delivered to the cathode chamber so that an acid solution is formed and oxygen gas is generated at the anode and so that a sodium hydroxide solution is formed and hydrogen gas is generated at the cathode.

According to another alternative embodiment, the electrolysis is carried out in a cell that is provided with anode, cathode an anion selective and a cation selective membrane, wherein sodium sulphate solution is introduced between the two membranes and water is introduced to the anode chamber and the cathode chamber respectively, so that a sulphuric acid solution is formed and oxygen gas generated at the anode and so that a sodium hydroxide solution is formed and hydrogen gas generated at the cathode.

According to a third, more advanced alternative, the treatment is carried out in a multi chamber cell that is provided with anode, cathode and anion selective, cation selective and bipolar membranes, wherein the anode chamber is delimited by an anion selective membrane and the cathode chamber is delimited by a cation selective membrane, and wherein bipolar membranes are disposed between said membranes and wherein sodium sulphate solution is delivered to those chambers that are delimited by bipolar membranes, so that a sulphuric acid solution is formed in at least the membrane chamber which is placed nearest the cathode and hydrogen gas is generated at said cathode, and so that a sodium hydroxide solution is formed at least in the membrane chamber which is placed nearest the anode, and oxygen gas is generated at said anode.

According to this third alternative, oxygen gas and hydrogen gas are formed in smaller quantities than in the two preceding alternatives, since these electrode reactions do not take place at the bipolar membranes. This third method is referred to as electrodialysis.

The first and the second alternative methods, i.e. the methods which describe conventional electrolysis, are particularly preferred because of their simplicity.

The acid solution (sulphuric acid solution) and the sodium hydroxide solution respectively formed in the aforesaid cells are removed from the cell individually and the acid solution (the sulphuric acid solution) is delivered to the cellulose pulp so as to obtain the acidity required and desired for the ozone bleaching process. Sodium hydroxide is also a valuable chemical which can be used, for instance, in the alkaline stage of the cellulose pulp treatment process, this stage often following the ozone bleaching stage. If desired, the intrinsically valuable chemicals oxygen and hydrogen can also be collected.

Advantages

The invention enables the consumption of externally produced (purchased) acid and externally produced (purchased) alkali to be greatly reduced in the manufacture of cellulose pulp that is bleached with ozone. The secondary products oxygen gas and hydrogen gas can be used in the cellulose pulp manufacturing process, for example for oxygen gas bleaching and steam generation respectively. The invention primarily leads to the possibility of mastering the environmental problems in a practically complete closing of the pulp manufacturing process, i.e. also including final bleaching waste liquors. When commercial sulphuric acid is used to achieve the necessary acidity of the cellulose pulp in an ozone bleaching process, it would mean, for instance, that 12,000–18,000 tonnes of sodium sulphate must be ejected per year from the process in an average sized sulphate pulp mill, when this alternative is chosen for maintaining a chemical balance in the system.

BEST MODES OF CARRYING OUT THE INVENTION

Preferred embodiments of the invention are described in the following with reference to the drawings. Two exemplifying embodiments are also described. In connection herewith, the description includes more detailed information as to how the inventive method is carried out.

Figure 1:
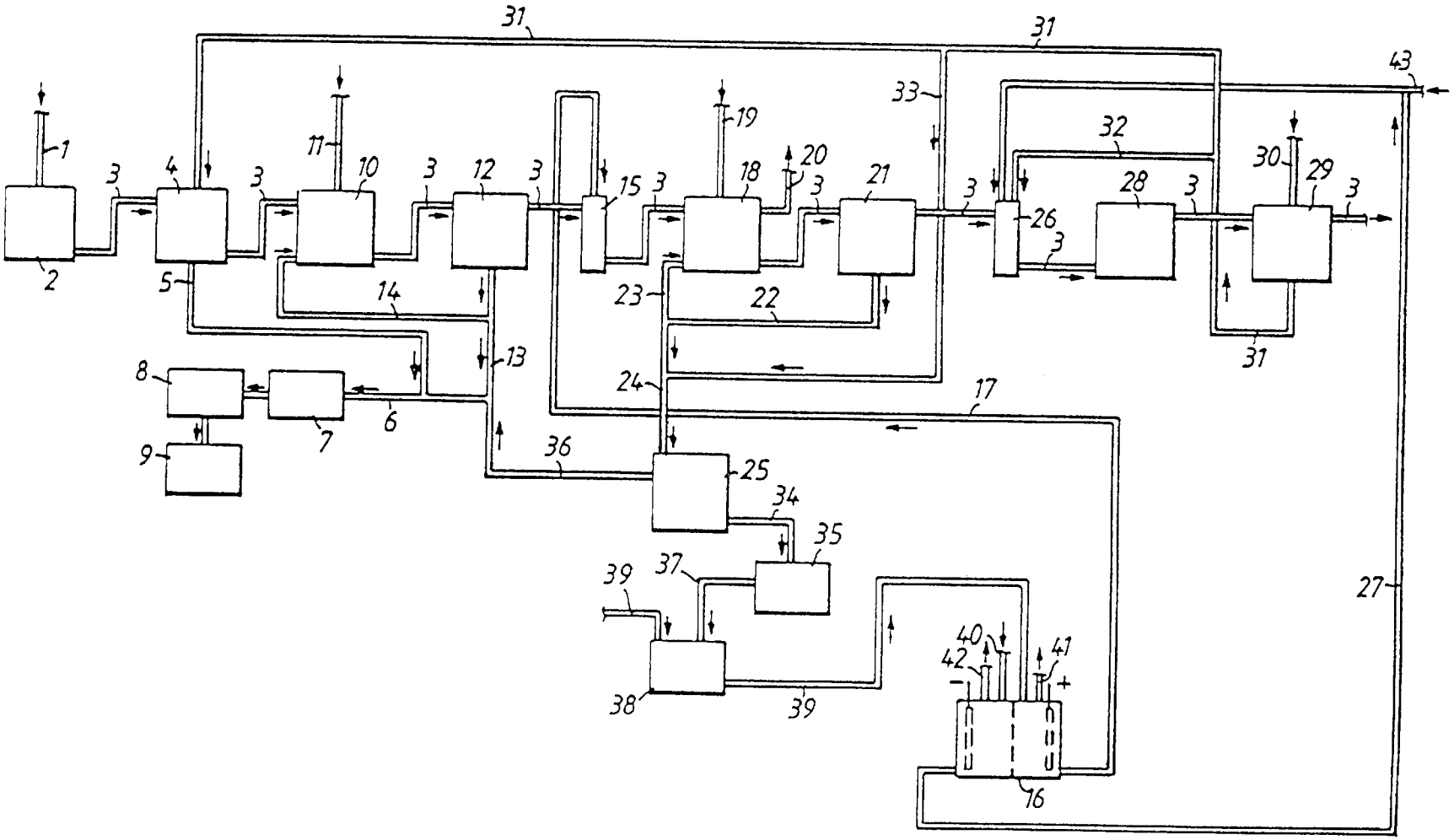
FIG. 1 is a flow sheet which illustrates a pulp manufacturing process in which a first embodiment of the lnvention is included and described, this embodiment including mixing together ozone bleaching waste liquor and some other alkaline waste liquor.

According to FIG. 1 pine chips are delivered through the conduit 1 to the digester 2, which contains a cooking liquor composed essentially of sodium hydroxide and sodium sulphide. Subsequent to digesting the wood and exposing the fibres thereof, the exposed fibres—the pulp—is transported through the pulp conduit 3 (which extends through the entire pulp mill) to the washing section 4, where the major part of the consumed cooking liquor (the cooking waste liquor or the black liquor) is extracted from the pulp. The cooking waste liquor is transported through conduits 5 and 6 to the chemical recovery system of the mill, this system including, among other things, an evaporation plant 7 and a combustion plant (recovery boiler) 8. which is provided with an electric precipitator 9.

Subsequent to washing of the pulp in the washing department 4 and subsequent to optional screening of the pulp (not shown in the drawing), the pulp is passed to an oxygen bleaching stage where the pulp is supplied with oxygen gas, through the conduit 11, and also with alkali, normally sodium hydroxide, and optionally also with a protector. The oxygen bleached pulp is passed to a washing stage 12 in which the pulp is freed from the major part of the waste liquor deriving from the oxygen bleaching stage. The aforesaid treatment process is carried out advantageously in a conventional press or in a washing press to which washing liquid is added. The pulp is brought to the desired consistency for the following ozone bleaching process of the pulp, by adjusting the pressure at which the pulp is pressed. The oxygen bleaching waste liquor pressed from the pulp is passed through the conduits 13 and 6 to the traditional chemical recovery system. Part of the oxygen bleaching waste liquor can be returned to the bottom of the oxygen bleaching reactor 10 through the conduit 14. The pulp, which has a comparatively high pulp consistency is then delivered to the mixer 15 in which an acid sodium sulphate solution is added to the still alkaline pulp, this sodium sulphate solution being prepared in the electrolysis cell 16 and transported through the conduit 17. The acid solution is added in a quantity which will ensure that the pH value of the pulp/water mixture will be suitable for the ozone bleaching of the pulp, i.e. within the range 2–5.

When the pulp leaves the mixer 15, it may, for instance, have a medium pulp consistency (10–15%) or a high pulp consistency (30–35%), depending on requirements. The pulp is then delivered to the ozone bleaching reactor 18 to which oxygen gas containing a given low ozone content is delivered, in addition to pulp, through the conduit 19. The ozone bleaching stage is maintained at a comparatively low temperature, for instance a temperature within the range of 40–60° C. The pulp reacts completely with the ozone in this stage, and residual oxygen gas is led from the reactor through the conduit 20, for transportation to an apparatus for generating fresh ozone (not shown in the Figure). The pulp is then transported to a further washing stage 21, for instance in the form of a washing press. The ozone bleaching waste liquor recovered is passed back to the system, through the conduit 22. The waste liquor is divided into two flows, of which one flow is passed through the conduit 23 back to the ozone bleaching reactor 18 for the purpose of flushing pulp from the reactor. The other flow is passed to a mixing and crystallizing vessel 25, through the conduit 24.

The pulp is then passed to a mixer 26 in which alkali, essentially sodium hydroxide, is added to the pulp. A significant part of the alkali is recovered in the form of a sodium hydroxide solution in the electrolysis cell 16, and the solution is added to the pulp in the mixer 26 through the conduit 27. The remainder of the sodium hydroxide required is supplied externally (purchased alkali) through the conduit 43. The pulp is then passed to an alkalizing or extraction tower 28. In addition to using a plain alkali stage in this stage of the process, it is possible, and even advantageous, to supply also oxygen or peroxide or both of these chemicals. Finally, the pulp is washed in the washing stage 29. It is quite possible to terminate the pulp manufacturing process at this stage and, for instance, to transport the pulp to a paper mill and/or to a dewatering and drying machine for the manufacture of commercial pulp. However, it is often desired to increase both the cleanliness and the brightness of the pulp by undertaking one or more additional bleaching stages while using bleaching chemicals such as, e.g., dithionite, peroxide, chlorine dioxide or additional ozone.

When the bleaching process is terminated at the aforesaid alkali stage, clean water is normally added to the pulp through the conduit 30. The alkaline waste liquor is returned in the system through the conduit 31. The recovered waste liquor is divided into three parts. A first part is added through the conduit 32 to the mixer 26, where it is mixed with the pulp so as to increase its alkali content. A second part is delivered through the conduit 33 to the conduit 24 where the alkaline waste liquor is mixed with the acid ozone bleaching waste liquor so that the waste liquor mixture delivered to the crystallization vessel 25 is generally neutral, i.e. has a pH of 7 or a value in the vicinity thereof. The remaining quantity of waste liquor is passed through the conduit 31 to the pulp washer 4, immediately downstream of the digester 2.

The waste liquor mixture in the vessel 25 is cooled to a temperature of, e.g., 15° C. or therebelow. A major part of the sodium sulphate present in the waste liquor will then precipitate in the form of crystals, which settle on the bottom of the vessel 25. The crystals are then passed through the conduit 34 to a washing filter 35, with the aid of an appropriate feeding out device. The waste liquor—mother liquor—freed from the sodium sulphate crystals in the vessel 25 is discharged through the conduit 36 and mixed with oxygen bleaching waste liquor and cooking waste liquor (black liquor) for transportation into the evaporator plant 7.

The sodium sulphate crystals are washed and cleaned on the filter 35 with a small quantity of liquid, and are thereafter passed to the dissolving vessel 38 through the conduit 37. The liquid removed from the sodium sulphate crystals on the filter 35 may, for instance, be introduced in the conduit 36 (not shown in the Figure). Preferably, clean water is passed through the conduit 39 to the dissolving vessel 38 in a quantity such that essentially all sodium sulphate crystals are dissolved. The dissolving process is facilitated by using a temperature which is slightly higher than room temperature and which, for instance, reaches 35° C. The solution containing a large quantity of dissolved sodium sulphate is transported through .the conduit 39 to the anode chamber of the electrolysis cell 16. Preferably clean water is delivered to the cathode chamber in the electrolysis cell 16 through the conduit 40. During the process of electrolysis, there is formed at the anode an acid solution which is recovered in the manner earlier described, while at the cathode there is formed a sodium hydroxide solution which is recovered in She aforedescribed manner. Oxygen gas is also generated in the anode chamber, this gas being led away through the conduit 41, while hydrogen gas is generated in the cathode chamber and led away through the conduit 42.

Figure 2:
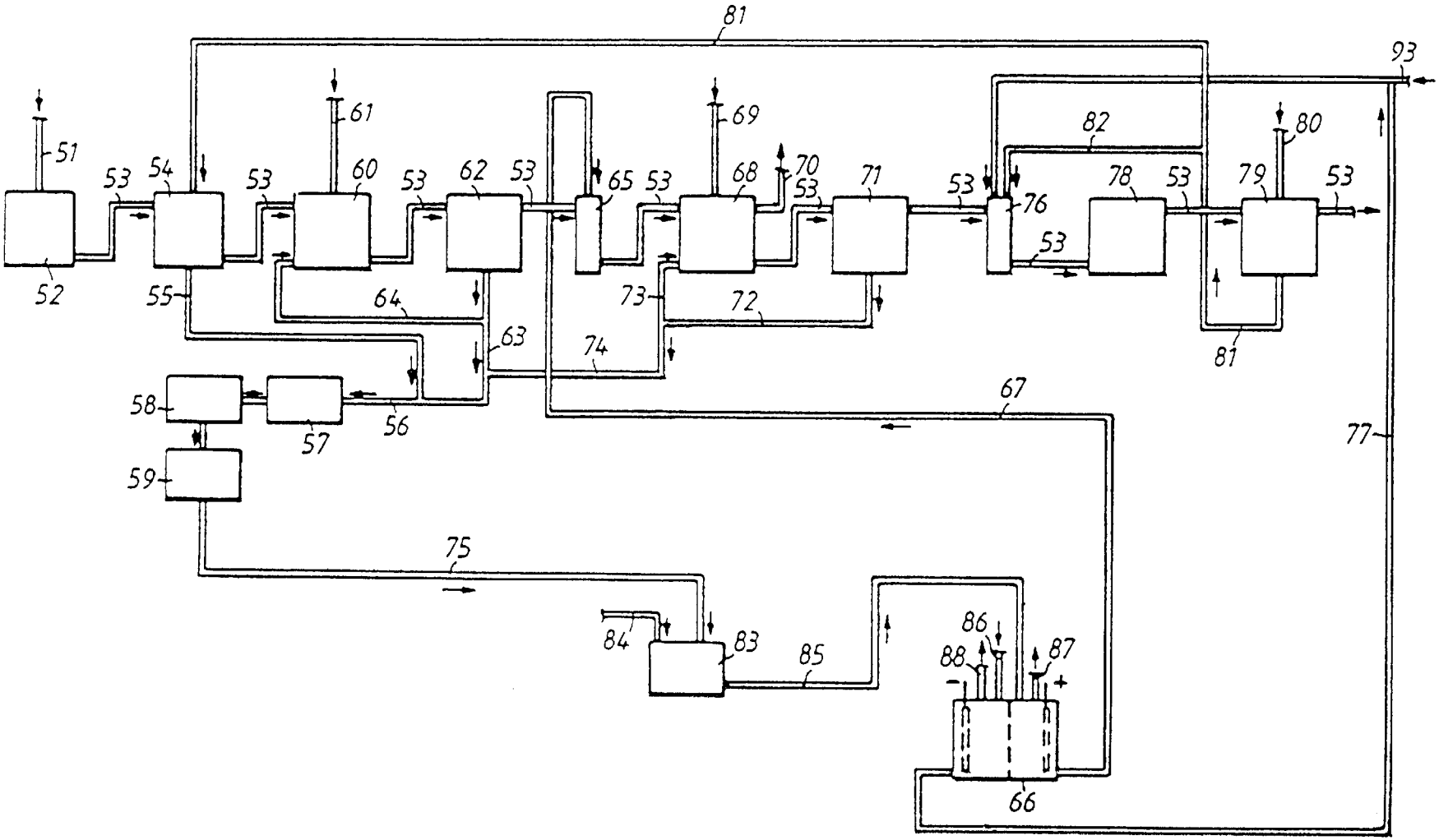
FIG. 2 illustrates a flow sheet for a pulp manufacturing process in which a second embodiment of the invention is included and described, this embodiment including returning ozone bleaching waste liquor to the chemical recover system of the pulp mill.

In FIG. 2 is a flow sheet shown, which coincides totally with the flow sheet of FIG. 1 with regard to the pulp manufacturing (and pulp refining) process. A large part of the liquid and waste liquor transportation is also effected in direct agreement with the two flow sheets. Consequently, those reference signs used in FIG. 2 that are in agreement with the FIG. 1 illustration are used with the addition of +50 except with respect to those few deviations which exist when making a comparison between the two embodiments of the invention.

In order to avoid unnecessary repetition, only those part stages in the flow sheet of FIG. 2 which differ from what is shown in the flow sheet of FIG. 1, will here be described and commented on.

According to this embodiment of the invention, the waste liquor is conducted from the washing stage 71, which is located immediately downstream of the ozone bleaching stage 68, through the conduits 72 and 74 to the conduit 63, where the mentioned ozone bleaching waste liquor is mixed with oxygen bleaching waste liquor from the washing (press) stage 62. The mixture concerned is transported to the evaporation plant 57 through the conduit 56. The waste liquor concentrated by evaporation, the thick liquor, is then passed to the recovery boiler 58 in which it is burned. The organic material content of the thick liquor is now converted to carbon dioxide and water, whereas its inorganic content is essentially recovered as sodium carbonate and sodium sulphide in the bottom part of the recovery boiler. However, a significant part of the inorganic material accompanies the flue gases and is separated as sodium sulphate in the electric precipitator 59. All or a part of the sodium sulphate recovered is passed in powder form to the dissolving tank 83, through the conduit 75. Preferably, clean water is added through the conduit 84 in an amount such that all sodium sulphate will be dissolved. If it is necessary to purify the solution from foreign chemicals, this can be effected in a following treatment stage (not shown in the Figure). The resultant sodium sulphate solution is transported through the conduit 85 to the anode chamber of the electrolysis cell 66. Preferably clean water is introduced to the cathode chamber of the electrolysis cell 66, through the conduit 86. Oxygen gas formed in the anode chamber is led away through the conduit 87 and hydrogen gas formed in the cathode chamber is led away through the conduit 88. The acid solution generated in the process of electrolysis is transported through the conduit 67 to the mixer 65, for necessary acidification of the pulp prior to the pulp coming into contact with ozone in the bleaching stage 68. The sodium hydroxide solution produced in the process of electrolysis is transported through the conduit 77 to the mixer 76, in which the pulp is made alkaline.

These two flow sheets illustrate applications of the invention when bleaching sulphate pulp with ozone, this pulp having been subjected to an oxygen bleaching process prior to the ozone bleaching stage. Reference has earlier been made to suitable final bleaching stage or stages when desiring to further increase the cleanliness and brightness of the pulp. Similarly, it is possible to introduce further delignifying and/or bleaching stages between the digestion stage, i.e. the manufacture of the original pulp, and the ozone bleaching stage. Advantageously, an acid treatment stage can be included, for instance by allowing the pulp to react with a gas that contains nitrogen dioxide (this process is known as PRENOX), immediately prior to the oxygen bleaching stage. In addition to an oxygen bleaching stage in the mentioned position, there can be applied a plain alkali stage, or a peroxide reinforced alkali stage, or an alkali stage which is reinforced with both peroxide and oxygen. Irrespective of whether an acid treatment stage, for instance in accordance with the PRENOX method, is introduced in the mentioned position or not, it may be beneficial to treat (bleach) the pulp with chlorine dioxide, with or without intermediate washing of the pulp, immediately prior to the ozone bleaching stage.

As previously mentioned, the inventive method is in no way limited to the ozone bleaching of sulphate pulp, but can be applied to the ozone bleaching of any chemical pulp whatsoever and also to the ozone bleaching of chemimechanical pulp. When bleaching such pulps, the bleaching sequences can be quite different to the aforedescribed and mentioned bleaching sequences. With regard, for instance, to sulphite pulp, this pulp will have after the digestion stage a much lower lignin content and a much higher brightness than sulphate pulp, which means that only two bleaching stages and at most three bleaching stages, of which one is an ozone bleaching stage, are required in order to obtain a highly clean and bright pulp.

Figure 3:
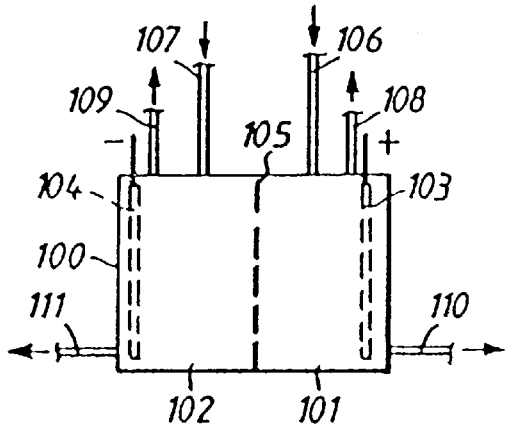
FIGS. 3, 4 and 5 illustrate in detail a partial stage of the invention. namely in FIGS. 3 and 4 the electrolysis of the sodium sulphate solution produced, and in FIG. 5, the electrodialysis of the sodium sulphate solution produced.

In FIG. 3 shows in more detail the construction of an electrolysis cell similar to that shown in FIGS. 1 and 2 and illustrates how decomposition of the sodium sulphate takes place.

The electrolysis cell 100 is comprised of two chambers, the anode chamber 101 and the cathode chamber 102. An anode 103 is arranged in the first mentioned chamber and a cathode 104 is arranged in the other chamber. The two chambers are mutually separated by a cation selective membrane 105, which will only allow sodium ions to pass through. Sodium sulphate solution is added t6 the anode chamber 101 through the conduit 106 and water is added to the cathode chamber 102 through the conduit 107. As a result of applying an electric voltage across the cell, hydrogen ions are formed at the anode 103 while generating oxygen gas at the same time, this gas being led away from the cell through the conduit 108. Hydroxide ions are formed at the cathode 104 at the same time as hydrogen gas is generated, this gas being led away from the cell through the conduit 109. The current efficiency in the electrolysis process is greatly dependent on the concentrations of hydrogen ions and hydroxide ions respectively in respective chambers. Consequently, it is not possible in this type of electrolysis cell to produce two hydrogen ions=$H^+$, for each sulphate ion=$SO_4^{2-}$ and normally it is necessary to be satisfied with a yield of one hydrogen ion or slightly more with each sulphate ion. A part of the sodium sulphate is therefore still not decomposed. Consequently, the solution removed from the anode chamber 101 through the conduit 110 is designated an acid sodium sulphate solution. A sodium hydroxide solution is removed from the cathode chamber 102 through the conduit 111. The destination of these solutions will be apparent from the earlier description.

Figure 4:
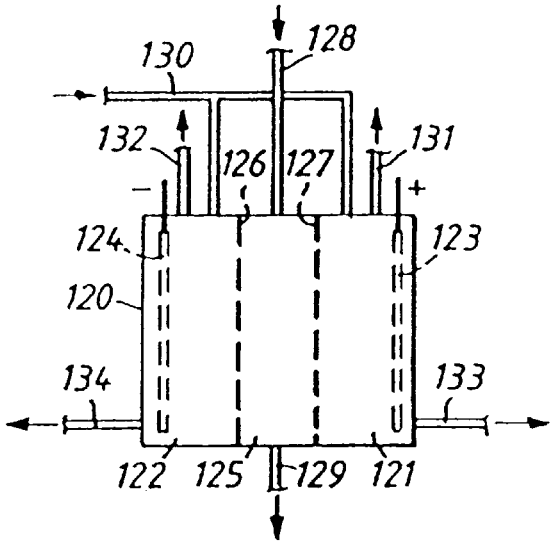

When desiring to produce two hydrogen ions for each sulphate ion, i.e. to produce sulphuric acid, an electrolysis cell 120 having three chambers can be used, as shown in FIG. 4.

This cell also includes an anode chamber 121. and a cathode chamber 122. An anode 123 is arranged in the anode chamber while a cathode 124 is arranged in the cathode chamber. Located centrally between these two chambers is a further chamber 125 which is encircled by a cation selective membrane 126 which allows sodium ions to pass through, and an anion selective membrane 127 which allows sulphate ions to pass through. Sodium sulphate solution is delivered to the cell through the conduit 128 and is recycled back to the conduit (in a lower concentration) through the conduit 129. Water is delivered to the cell through the conduit 130, to both the cathode chamber 122 and the anode chamber 121.

When an electric voltage is applied over the cell 120, oxygen gas is generated at the anode 123, this gas being led away through the conduit 131, at the same time as sulphuric acid ($H_2SO_4$ or $2H^++SO_4^{2-}$) is formed in the anode chamber 121. Hydrogen gas is generated at the cathode 124 and is led away from the cell through the conduit 132, at the same time as sodium hydroxide (NaOH or $Na^++OH^-$) is formed in the cathode chamber 122. Respective solution is led away from the cell 120 through the conduits 133 and 134 and the chemicals concerned are used in the manner earlier mentioned.

Figure 5:
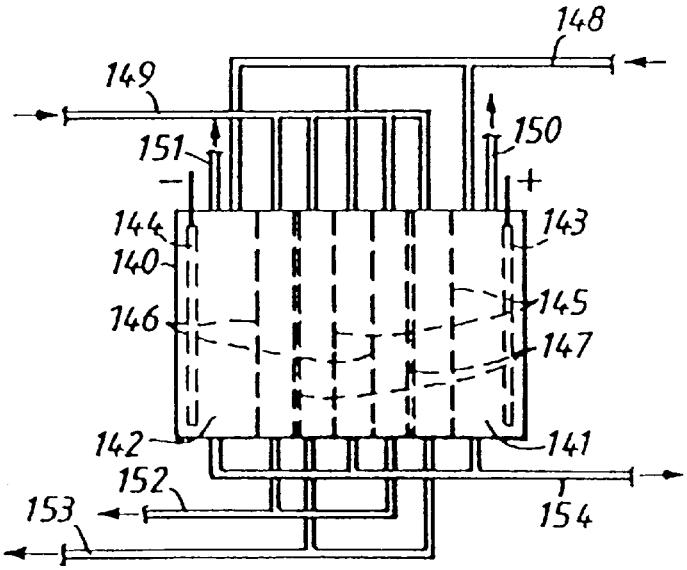

When desiring to reduce the amount of oxygen gas and hydrogen gas formed in relation to the major products acid and alkali in comparison with those electrolysis processes described with reference to FIGS. 3 and 4, a cell 140 of the type illustrated in FIG. 5 can be used.

This cell also has an anode chamber 141 and a cathode chamber 142 having respectively an anode 143 and a cathode 144. The anode chamber 141 is delimited on one side by an anion selective membrane 145, while the cathode chamber 142 is delimited on one side by a cation selective membrane 146. Arranged between these two membranes are two bipolar membranes 147 and between these a further cation selective membrane 146 and an anion selective membrane 145 are arranged. Sodium sulphate solution is added to the anode chamber 141 and the cathode chamber 142 respectively through the conduit 148, and also to each third chamber between the bipolar membranes, which can be included in a greater or smaller number. Water is added to remaining cell chambers through the conduit 149. When an electric voltage is applied across the cell, oxygen gas is generated at the anode 143 and led away through the conduit 150, and hydrogen gas is generated at the cathode 144 ahd led away through the conduit 151. Furthermore, sodium ions migrate in a direction towards the cathode 144 and sulphate tons migrate in a direction towards the anode 143. The water is dissociated to hydrogen ions and hydroxide ions at the same time. Surphuric acid ($H_2SO_4$ or $2H^+ + SO_4^{2-}$) and sodium hydroxide respectively are formed in this way. Sulphuric acid solution is led away from two of the membrane chambers and transported through the conduit 152 for use in accordance with the earlier description. Sodium-hydroxide solution is led away from two other membrane chambers and transported through the conduit 153 for use in accordance with the earlier description. Sodium sulphate solution (of lower concentration) is led away from the bottom of the three chambers where fresh such solution is added to the upper part of the cell and recycled back to the conduit 148, through the conduit 154. The decomposition of sodium sulphate and water illustrated in FIG. 5 is normally designated electrodialysis.

It will be understood that other processes of electrolysis respectively electrodialysis can also be applied when carrying out the inventive method.

A number of experiments have been carried out with the method according to the present invention. The manner in which these experiments were carried out and the results obtained will be evident from the following working examples. The experiments concerned were carried out on a pilot-plant scale.

EXAMPLE 1

The experiment was carried out with a pine sulphate pulp having a Kappa number of 29.0 and a viscosity of 1,250 $dm^3$/kg. The pulp was oxygen bleached at a pulp consistency of 12% and at an oxygen pressure of 5 $kg/cm^2$. 2% sodium hydroxide and 0.3% magnesium in the form of magnesium sulphate ($MgSO_4$) had earlier been supplied to the pulp. Upon completion of the oxygen bleaching process, the pulp had a Kappa number of 15.0 and a viscosity of 1,010 $dm^3$/kg. The pulp was then pressed to a pulp consistency of 40%. Inorganic chemicals (washing losses) corresponding to 12 kg sodium sulphate per tonne of pulp were found to remain in the pulp. An acid sodium sulphate solution was then added. to a pulp flow of 100 kg/min. in an amount of 10 litre/min. The liquid contained 80 g/l of sodium sulphate and hydrogen ions, expressed as sulphuric acid, in an amount of 160 g/l. The pulp concentration fell therewith to 33% and the pH of the pulp-became 2.5.

The pulp was fluffed and introduced into an ozone bleaching reactor, where the pulp was allowed to react with ozone added in a quantity of 0.4 kg/min in a flow of 5.7 kg/min oxygen gas. The temperature was 50° C. and the treatment time 30 minutes. The oxygen gas freed from ozone was removed from the reactor. At the end of the treatment time, liquid was added so as to flush away the pulp. Dilution liquid in the form of water was added in an amount of 540 l/min. The pulp was then pressed to a pulp consistency of 30%. The resultant ozone bleaching waste liquor was thereby recovered. The pulp was then transferred to a mixer, to which 2.7 kg of sodium hydroxide/min were added. The pulp was allowed to react with the alkali for 120 minutes at a temperature of 65° C. and a pulp concentration of 14%. The pulp was then washed with clean water so as to obtain an alkaline waste liquor.

The Kappa number of the pulp after this treatment stage was 7.3, its viscosity 903 $kg/dm^3$ and its brightness 53% ISO.

The Kappa numbers, viscosities and brightnesses recited in this patent application have been determined in accordance with SCAN-C 1:77, SCAN-CM 15:88 and SCAN-C 11:75 respectively.

The ozone bleaching waste liquor in an amount of 15 l/min., containing 310 g/l sodium sulphate, hydrogen tons, calculated as $H_2SO_4$, in an amount of 40 g/l and organic material in an amount of 90 g/l. was mixed with the alkaline waste liquor in an amount of 12 l/min so that the resultant pH of the mixture was 7.1. The mixture was transferred to a crystallization vessel, in which the mixture was cooled to 10° C. Sodium sulphate crystals in an amount of 3.3 kg/min were sepatated from the mixture (the mother liquor) and the sodium sulphate content thereof fell to 90 g/l.

These crystals were then dissolved in a vessel in clean water in a quantity such that the content of dissolved sodium sulphate became 430 g/l. This solution had a temperature of 35° C. and was added to the anode chamber of an electrolysis cell of the type illustrated in FIG. 3. Clean water was added to the cathode chamber of the cell. The cell temperature was 50° C., the voltage was 3.8 V. the current density was 25 $A/dm^2$ and the power consumption was 240 kW.

During the electrolysis process, oxygen gas was generated in the anode chamber in an amount of 190 l/min (0.27 kg/min) at the same time as an acid sodium sulphate solution was formed in which the hydrogen ions, calculated as sulphuric acid, rose to 1.7 kg/min (75% conversion). Hydrogen gas developed in the cathode chamber in an amount of 380 l/mmn (0.034 kg/min) at the same time as a sodium hydroxide solution was formed in an amount of 14 l/mmn at a concentration of 10%.

As previously mentioned, the resultant acid sodium sulphate solution contained 80 g/l sodium sulphate and hydrogen ions, expressed as sulphuric acid, in an amount of 160 g/l. The solution concerned was used fully to acidify the pulp prior to the ozone bleaching stage, as earlier described, so that the pulp had a pH of 2.5. The resultant sodium hydroxide solution was added to the pulp, as earlier mentioned, in the mixer prior to the alkalization treatment process. The sodium hydroxide content of this solution covered 50% of the sodium hydroxide addition to the pulp.

The following chemical savings were achieved in this experiment:

Acidifying chemical, calculated as sulphuric acid=17 kg per tonne of pulp;

Alkalizing chemical, sodium hydroxide=14 kg per tonne of pulp;

Oxygen gas=2.7 kg per tonne of pulp.

As earlier mentioned, when practicing the inventive method on a full scale, the oxygen gas can be used in an alklaline treatment stage, for instance in an introductory oxygen bleaching stage.

EXAMPLE 2

This experiment was carried out with a pine sulphate pulp having a Kappa number of 26.0 and a viscosity of 1,202 $dm^3$/kg. The pulp was bleached with oxygen gas at a pulp consistency of 12% and at an oxygen gas pressure of 6 $kp/cm^2$. 1.5% sodium hydroxide and 0.3% magnesium in the form of magnesium sulphate ($MgSO_4$) had earlier been added to the pulp. Upon completion of the oxygen bleaching process, the pulp had a Kappa number of 13.0 and a viscosity of 990 $dm^3$/kg. The pulp was then pressed to a consistency of 40%. Inorganic chemicals (washing losses) corresponding to 9 kg sodium sulphate per tonne of pulp were then found to remain in the pulp. A sulphuric acid solution of 10% concentration was then added to the pulp in a flow of 100 kg/min. The pulp consistency then fell to 38% and the pulp was found to have A pH=2.7.

The pulp was fluffed and introduced into an ozone bleaching reactor, where the pulp was allowed to react with ozone, which was added in a quantity of 0.3 kg/min in an oxygen gas flow of 4.3 kg/min. The temperature was 50° C. and the treatment time 30 minutes.

The oxygen gas freed from ozone was withdrawn from the reactor. At the end of the treatment time, liquid was added so as to flush away the pulp. Dilution liquid in the form of water was added in an amount of 500 l/mmn. The pulp was then pressed to a pulp consistency of 30%. The resultant ozone bleaching waste liquor was recovered. The pulp was then transferred to a mixer to which 2.5 kg sodium hydroxide/min was added. The pulp reacted with the alkali for 130 minutes at a temperature of 60° C. and a pulp consistency of 14%. The pulp was then washed with clean water so as to obtain analkaline waste liquor. Subsequent to this treatment stage, the pulp was found to have a Kappa number of 6.7. a viscosity of 900 kg/$dm^3$ and a brightness of 55% ISO.

Precipitator dust from the sulphate mill from which the experiment pulp was taken was dissolved in an amount of 1.8 kg/min in clean water. The amount of water used was such that the resultant solution had a sodium sulphate content of 360 g/l. The dissolving took place at a temperature of 55° C. In this experiment, there was used an electrolysis cell which had three chambers of the type Illustrated in FIG. 4. The cell included two membranes. The sodium sulphate solution was added to the centre chamber, i.e. the chamber located between the two membranes. Clean water was added to the anode chamber and the cathode chamber respectively. The cell temperature was 55° C., the voltage 4.2 V, the current density 20 A/$dm^2$ and the power consumption 190 kW.

During the electrolysis process, oxygen gas developed in the anode chamber in an amount of 135 l/min (0.19 kg/min) at the same time as sulphuric acid was formed in an amount of 1.2 kg/mn in a concentration of 10%. Hydrogen gas was developed in the cathode chamber in an amount of 270 l/min (0.024 kg/min) at the same time as a sodium hydroxide solution was formed in an amount of 1.0 kg/min at a concentration of 10%. The electrolyzed sodium sulphate solution was removed from the bottom of the centre chamber and was found to still contain a given content of sodium sulphate, this solution being recycled and mixed with fresh sodium sulphate solution, which was added to the cell at the upper part of the centre chamber.

The sulphuric acid solution obtained was used fully to acidify the pulp prior to he ozone bleaching stage, as previously mentioned, such that the pH of the pulp was 2.7. The sodium hydroxide solution obtained was added to the pulp in the mixer, as earlier described, prior to the alkalizing treatment stage. The sodium hydroxide solution obtained was added to the pulp in the mixer as earlier described prior to the alkalizing treatment stage. The sodium hydroxide content of this solution covered 40% of the sodium hydroxide charged to the pulp.

The following chemical savings were achieved with this experiment:

Sulphuric acid=12 kg per tonne of pulp

Sodium hydroxide=10 kg per tonne of pulp

Oxygen gas=1.9 kg per tonne of pulp

What is claimed is:

1. A method of bleaching with ozone lignocellulosic pulp which has been at least partially manufactured chemically, in the presence of water at a degree of acidity, expressed as pH, of 2–5, wherein the acidity is maintained during the ozone bleaching process by adding a sulfuric acid solution or an acid sulphate solution, wherein the solution is prepared by electrolysis or electrodialysis of a neutral sodium sulfate solution obtained by mixing waste liquor from the ozone bleaching process with waste liquor from an alkaline treatment stage so as to obtain a neutral solution, and cooling the resultant solution so as to precipitate sodium sulphate therefrom; and removing the sodium sulphate precipitate and dissolving it in essentially clean water.

2. A method according to claim 1, wherein mother liquor obtained from crystallization of the sodium sulphate is transferred to a chemical system which includes an evaporation and combustion plant.

3. A method according to claim 1, wherein the electrolysis is carried out in a cell which comprises anode, cathode and a cation selective membrane, wherein sodium sulphate solution is added to the anode chamber and water is added to the cathode chamber so that an acid solution is formed and oxygen gas is generated at the anode and so that a sodium hydroxide solution is formed and hydrogen gas is generated at the cathode; and in that respective solution is removed from the cell and in that the acid solution is added to the ozone bleaching process.

4. A method according to claim 1, wherein the electrolysis is carried out in a cell which comprises anode, cathode, an anion selective membrane and a cation selective membrane, wherein sodium sulphate solution is added between the two membranes and water is added to the anode chamber and the cathode chamber respectively so that a sulphuric acid solution is formed and oxygen gas is generated at the anode and so that a sodium hydroxide solution is formed and hydrogen gas is generated at the cathode; in that respective solution is removed from the cell; and in that the sulphuric acid solution is added to the ozone bleaching process.

5. A method according to claims 1, wherein the treatment process (the electrodialysis) is carried in a multi chamber cell which comprises anode, cathode, anion selective, cation selective and bipolar membranes, wherein the anode chamber is delimited by an anion selective membrane and the cathode chamber is delimited by a cation selective membrane, and wherein the sodium sulphate solution is added to the anode chamber and the cathode chamber, and wherein bipolar membranes are disposed between said anion selective, membrane and said cation selective membrane; and in that water is added to those chambers which are delimited by bipolar membranes so that a sulphuric acid solution is formed at least in the membrane chamber which is situated nearest the cathode and hydrogen gas is generated at said cathode, and so that a sodium hydroxide solution is formed at least in the membrane chamber which is situated nearest the anode and oxygen gas is generated at said anode; in that respective solution is removed from the cell; and in that the sulphuric acid solution is delivered to the ozone bleaching process.

* * * * *